US005566701A

United States Patent [19]

Grey

[11] Patent Number: 5,566,701

[45] Date of Patent: Oct. 22, 1996

[54] COLLAPSIBLE DISPLAY FRAMEWORK

[76] Inventor: Stephen Grey, Unit 1/54 2019 Chegwyn St., Botany, Australia

[21] Appl. No.: 461,531

[22] Filed: Jun. 5, 1995

[51] Int. Cl.[6] ..... E04B 1/00

[52] U.S. Cl. ..... 135/98; 135/135; 135/147

[58] Field of Search ..... 135/97, 128, 135, 135/130, 147, 151, 153, 156, 98, 99, 20.1, 20.3, 15.1, 25.1, 25.31

[56] References Cited

U.S. PATENT DOCUMENTS

| | | | |
|---|---|---|---|
| 3,059,658 | 10/1962 | Finlayson | 135/147 |
| 3,502,091 | 3/1970 | Corbin | 135/97 |
| 3,766,932 | 10/1973 | Sidis et al. | 135/147 |
| 4,074,682 | 2/1978 | Yoon | 135/135 |
| 4,202,363 | 5/1980 | Watts et al. | 135/98 |
| 4,637,415 | 1/1987 | Dalo et al. | 135/98 |
| 4,882,884 | 11/1989 | Browne | 135/97 X |
| 5,361,794 | 11/1994 | Brady | 135/147 |

*Primary Examiner*—Lanna Mai
*Attorney, Agent, or Firm*—Jacobson & Johnson

[57] ABSTRACT

A collapsible support structure for a cover means (8). The structure includes at least three apex poles (1) with first ends pivotally connected together (2) so that in use the poles are movable between a raised configuration in which the opposite ends (7) of the apex poles extend outwardly to create a pyramid shaped frame and a collapsed configuration. There are pairs of perimeter poles (6) with each pair forming an inverted V between the opposite ends of adjacent apex poles when in the raised position.

9 Claims, 13 Drawing Sheets

COLLAPSIBLE DISPLAY FRAMEWORK

FIELD OF INVENTION

This invention relates to temporary or collapsible structures which may be used for example at indoor or outdoor sites or other places where an attractive short-term shelter is required.

DESCRIPTION OF PRIOR ART

There are of course many types of tent-like structures used for temporary shelter. These range from simple rectangular steel frames loosely hung with canvas to the more elaborate structures. Such known apparatus however have the disadvantage of requiring a large number of separate parts which have to assembled on site. This of course is time consuming and requires the employment of expensive skilled labour.

BRIEF DESCRIPTION OF INVENTION

It is therefore an object of this invention to ameliorate the aforementioned disadvantages and accordingly a relocatable collapsible support structure for a cover means is disclosed, said structure comprising at least three apex poles with first ends thereof pivotally connected together so that in use said poles are movable between a raised configuration in which the second opposite ends thereof extend outwardly in different directions to create a pyramid shaped frame and a collapsed configuration, and pairs of perimeter poles with each pair forming an inverted V between said opposite ends of adjacent apex poles when in said raised configuration so as to form together with said apex poles the aforesaid pyramid shaped frame and the apex poles and perimeter poles being pivotally connected so as to fold together into close substantially parallel positions when in the collapsed configuration and bracket means linking said apex poles intermediate said first and second ends said bracket means comprising braces which extend between and are pivotally attached to each apex pole and a central connector whereby the central connector may be pushed towards said first ends of said apex poles to obtain said raised configuration or away from said first ends to obtain said collapsed configuration and the bracket means including locking means for limiting movement of the central connector toward said first ends when in said raised configuration.

BRIEF DESCRIPTION OF DRAWINGS

The currently preferred forms of this invention will now be described with reference to the attached drawings in which.

DESCRIPTION OF PREFERRED EMBODIMENTS

Figure 1:
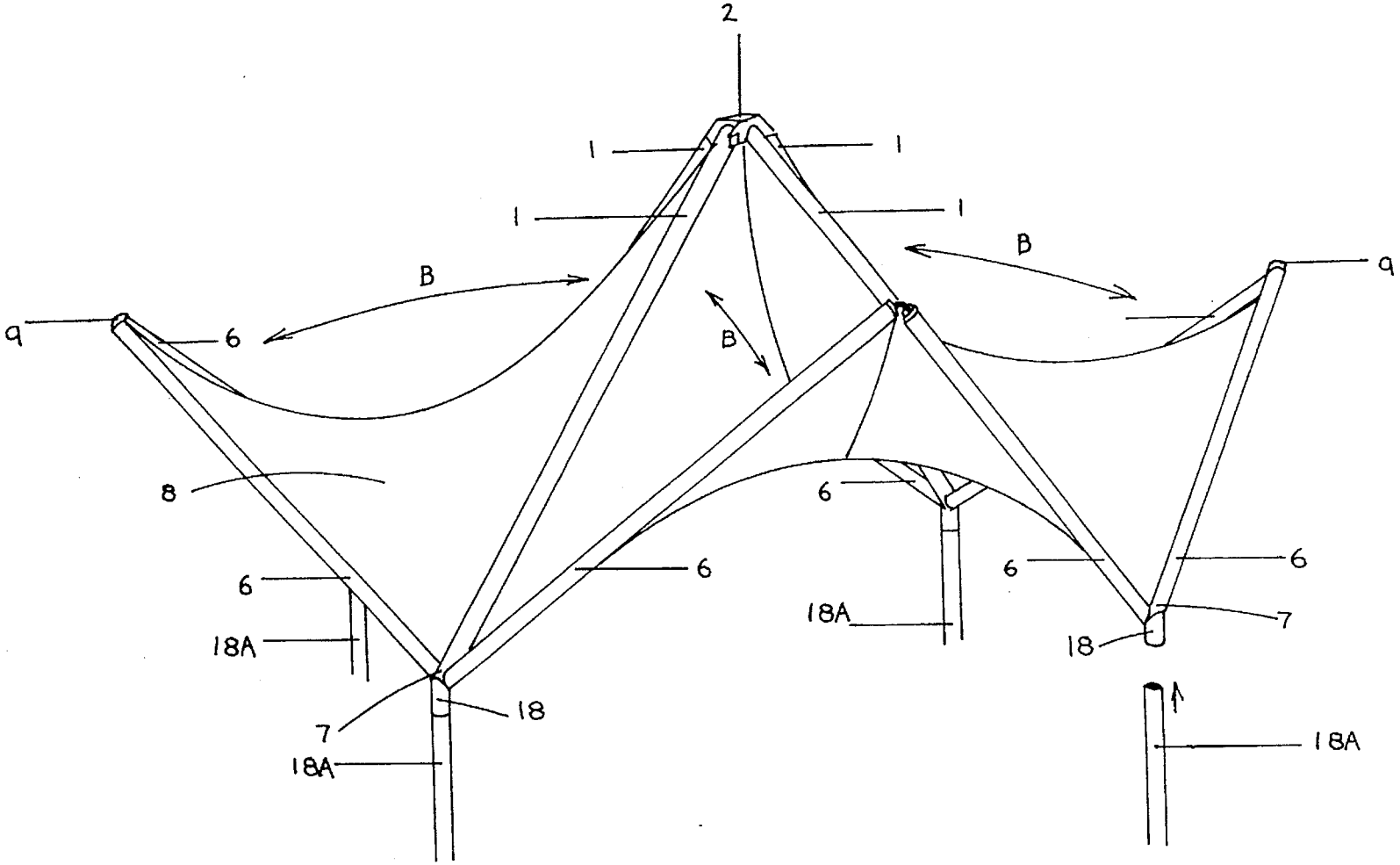
FIG. 1 is a perspective view of a structure according to this concept in the raised configuration.
Figure 2:
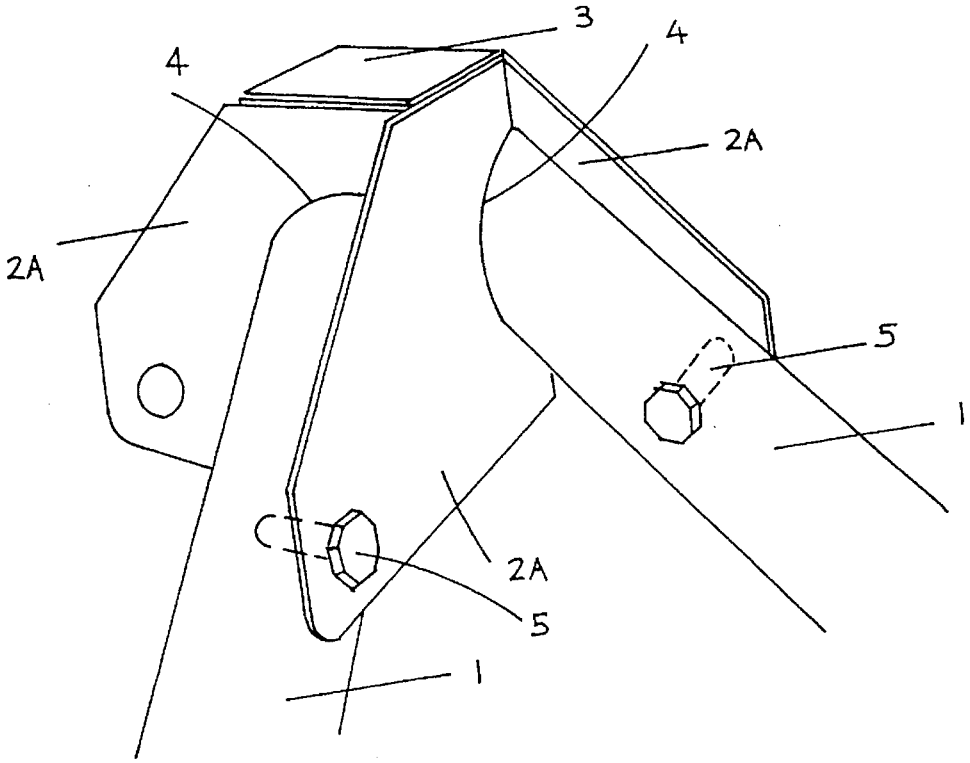
FIG. 2 shows a detailed view of one means of connecting the ends of the apex poles together.

Referring first to FIG. 1 the structure may in its raised configuration comprise four metal apex poles 1 which are joined together at their uppermost ends by a connector piece 2. A detailed view of the connector is shown in FIG. 2. It comprises a set of four vertical plates 2A (only three being shown in the drawing) arranged at right angles to each other around a central box member 3. The end sections of the apex poles are bolted through respective plates 2A and the end faces 4 of the poles are cut to a bevel so as to flatly engage the surface of the adjacent plate. Each apex pole is thus able to pivot with respect to the connector piece 2. However, the placement of the bolts 5 and the angle of the bevels are preferably chosen so that angle between opposite ones of the four apex poles when they are folded out is a maximum of 90°.

Referring back to FIG. 1 it can be seen that pairs of perimeter poles 6 also extend laterally from the centre of the structure in an inverted V between the outer ends 7 of the apex poles. These perimeter poles together with the apex poles thus define a central pyramid shaped frame with outwardly inclined wing sections on each side which may be used to support any suitable type of weatherproof covering 8.

Figure 3:
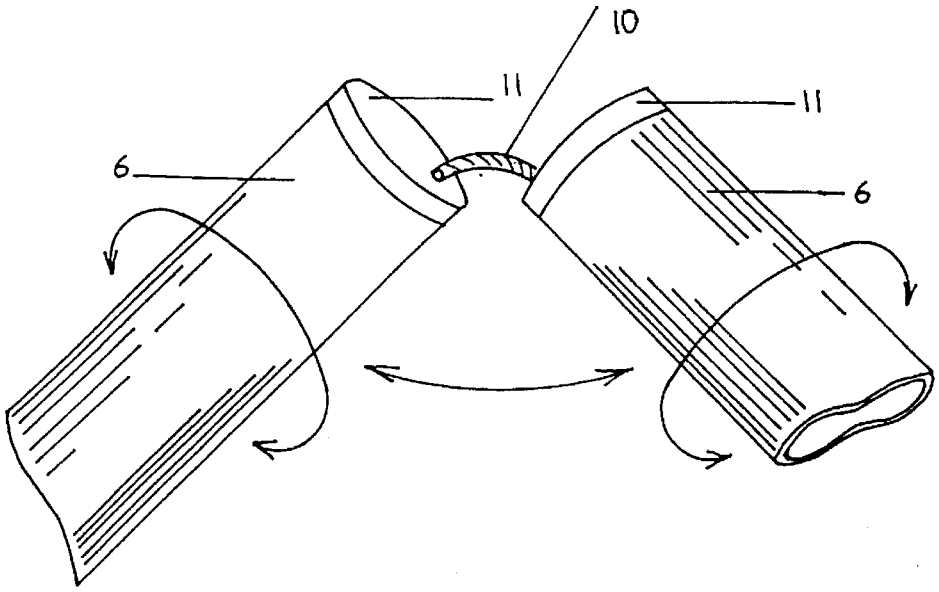
FIGS. 3 to 5 show one means of flexibly connecting the pairs of perimeter poles together.
Figure 4:
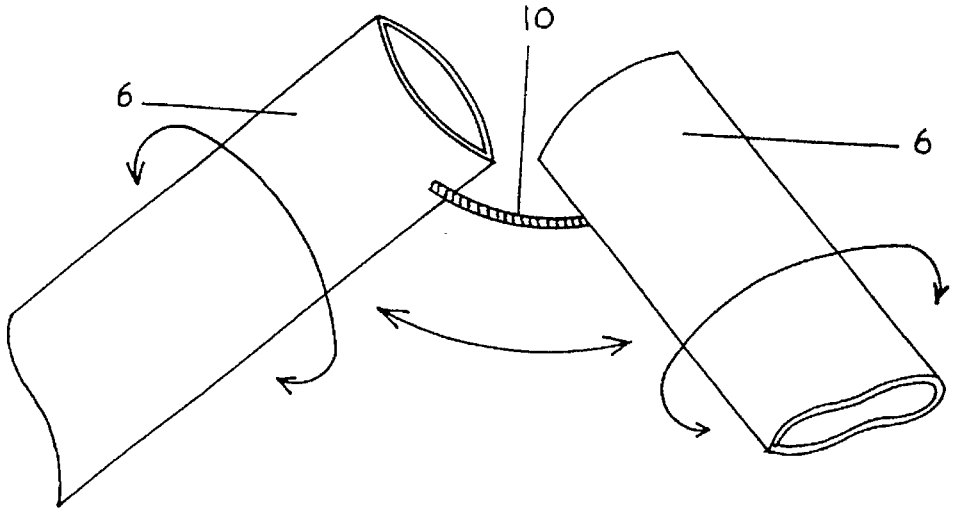
Figure 5:
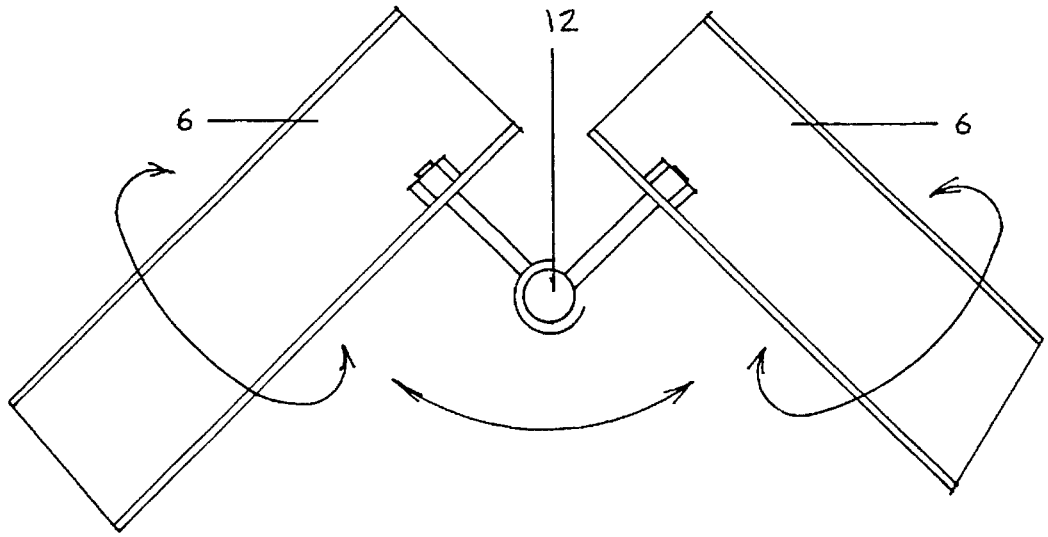

Two possible forms of joint 9 between the ends of the perimeter poles are shown in FIGS. 3 to 5. These may comprise a flexible chain or cord 10 which extends between, and is anchored inside, the walls of the poles or in end caps 11. This allows simultaneous relative movement of the poles about more than one axis which is advantageous when erecting the structure. As an alternative a mechanical ball and socket type joint 12 (see FIG. 5) may be fitted to the ends of the poles. These arrangements permit the adjoining perimeter poles to both hinge in the plane parallel to said poles and to partially rotate relative to each other to facilitate the opening and closing of the structure as described later.

Figure 6:
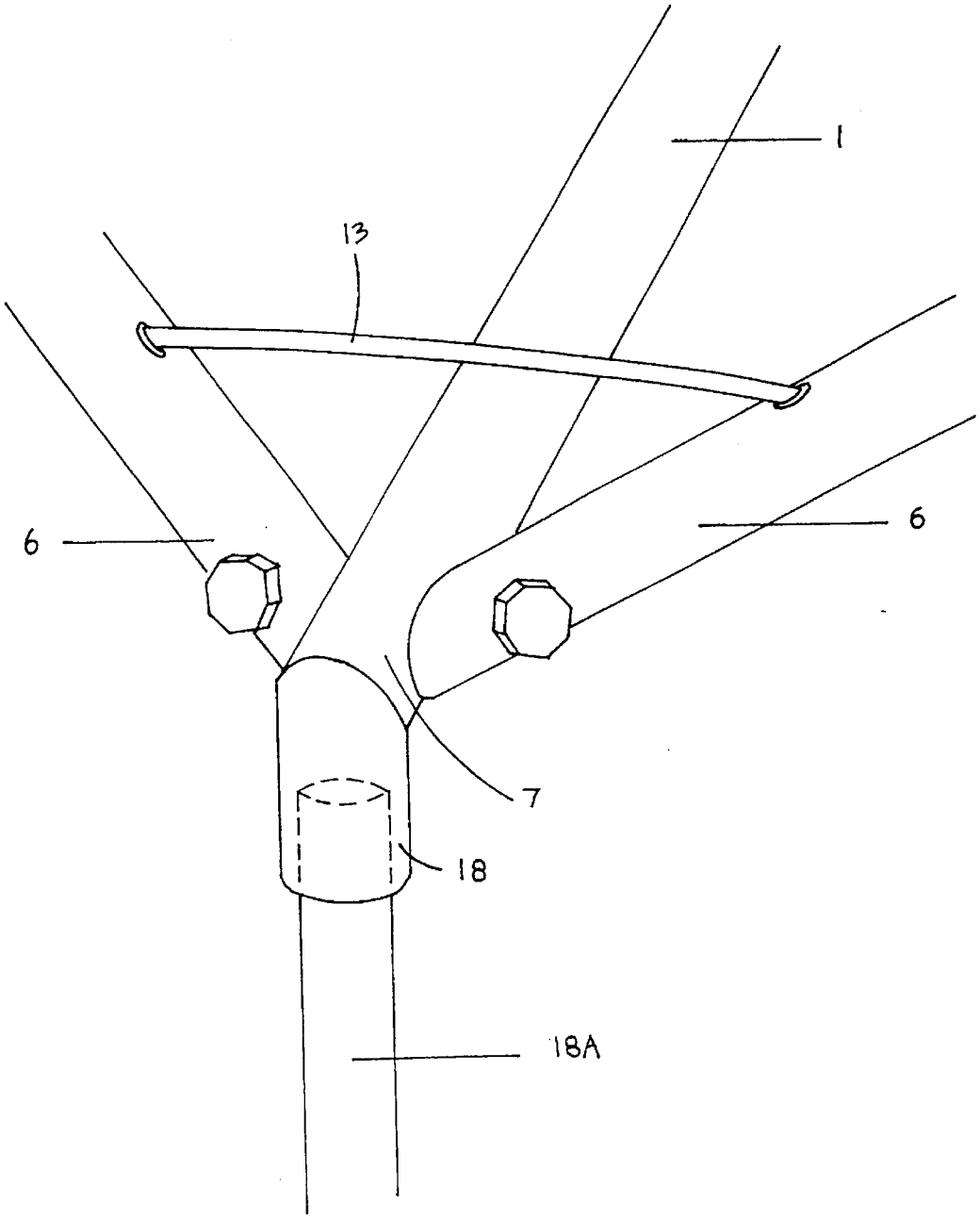
FIGS. 6 to 8 show the preferred means of connecting the perimeter poles to the outer ends of the apex poles.
Figure 7:
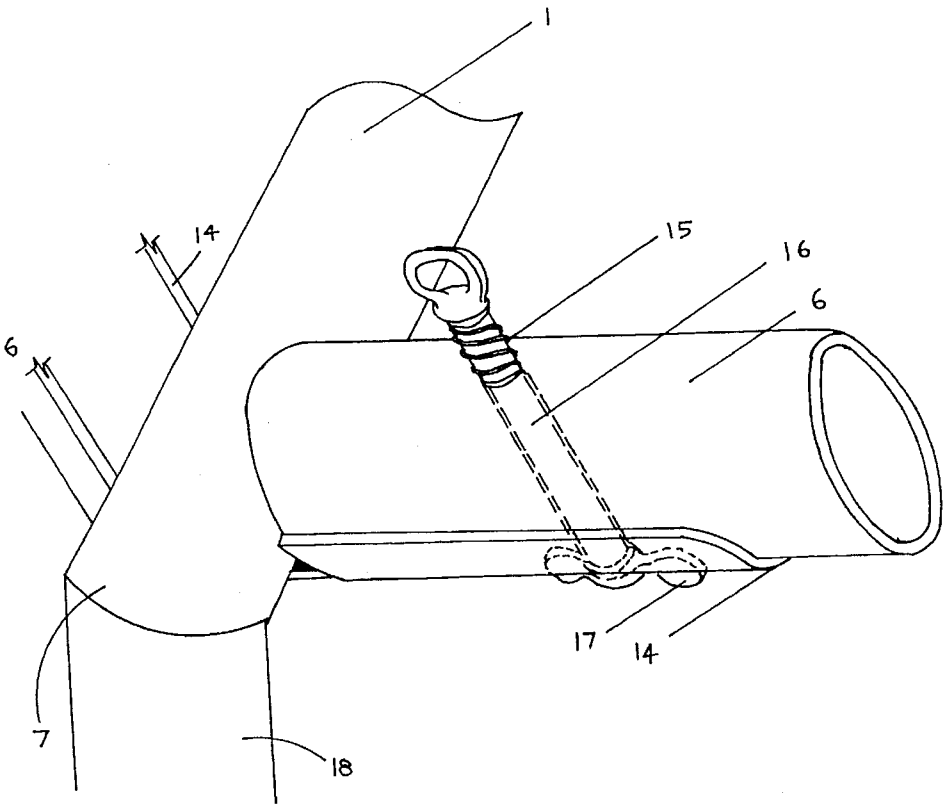
Figure 8:
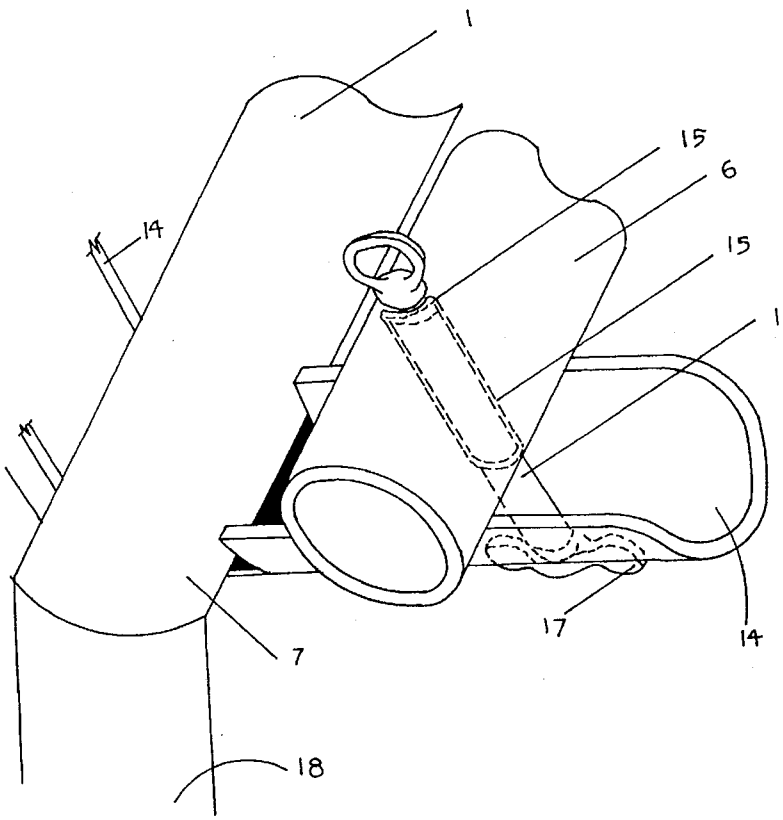

Two preferred types of joints between the perimeter poles 6 and the outer ends 7 of the apex poles are shown in FIGS. 6 to 8. In FIG. 6 the perimeter poles are bolted directly to the apex poles and any suitable type of strong flexible rod 13 extends between them. This serves to resiliently secure the perimeter poles at their outwardly extended position shown when the structure is open. Alternatively the end section 7 of each apex pole may be fitted with laterally extending flanges 14 having curved walls which in cross-section define slightly less than a semi-circle. When the structure is raised or opened the ends of the perimeter poles 6 sit within these flanges as shown in FIG. 7 and are held in place by compression springs 15 mounted on pins 16 passing diametrically through the perimeter poles and the flanges 14. Wing nuts 17 may also be fitted onto threaded ends of these pins 16 to adjust the spring tension and thus apply additional force to hold the perimeter poles in their respective flanges 14. In this way a strong and durable mechanism is provided to resiliently hold the perimeter poles in the extended position. The mechanism nevertheless still allows the poles to be folded into a substantially parallel configuration as shown in FIG. 8. Sleeve members 18 may also be fitted to the ends of the apex poles at this point to receive support legs 18A (see FIGS. 1 and 6).

Figure 9:
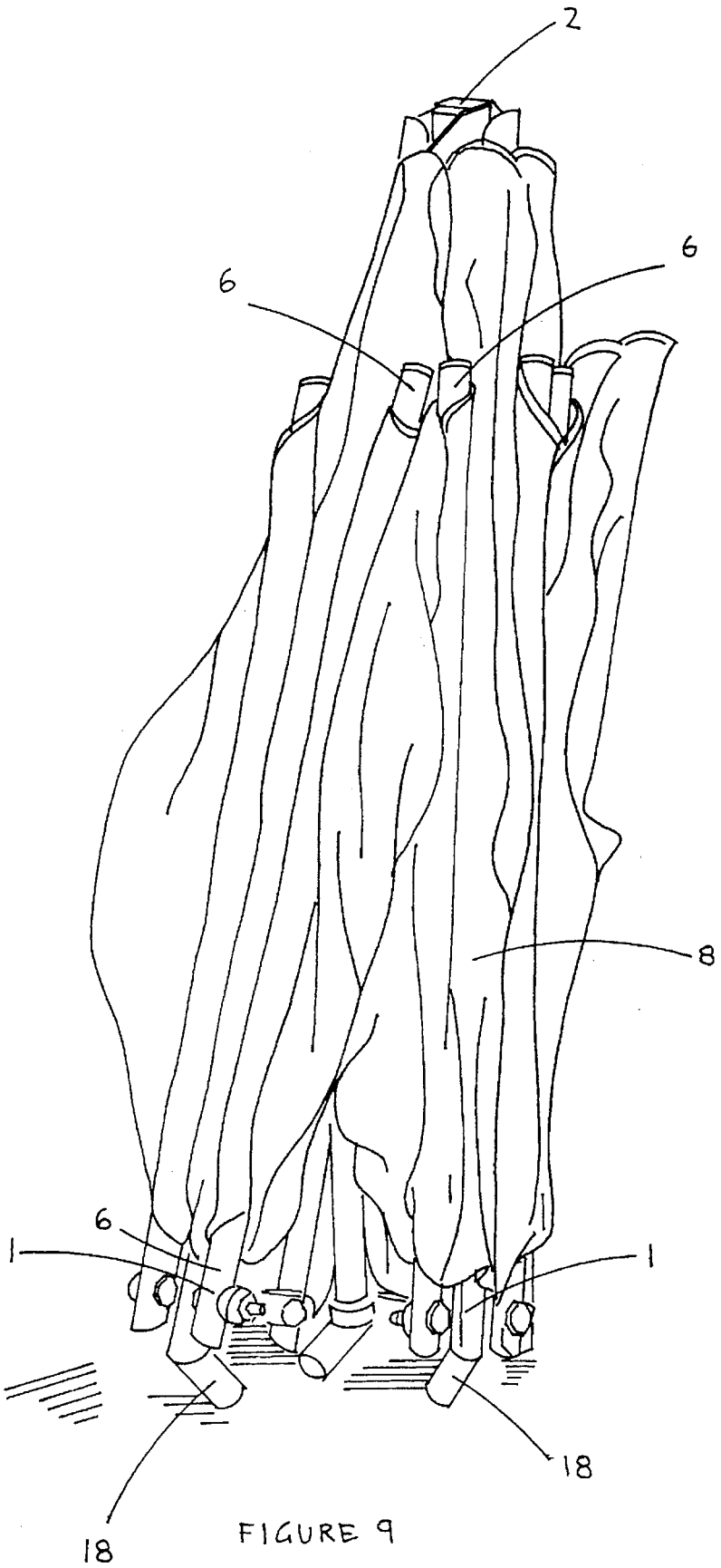
FIG. 9 shows the support structure of FIG. 1 in the collapsed configuration.
Figure 10:
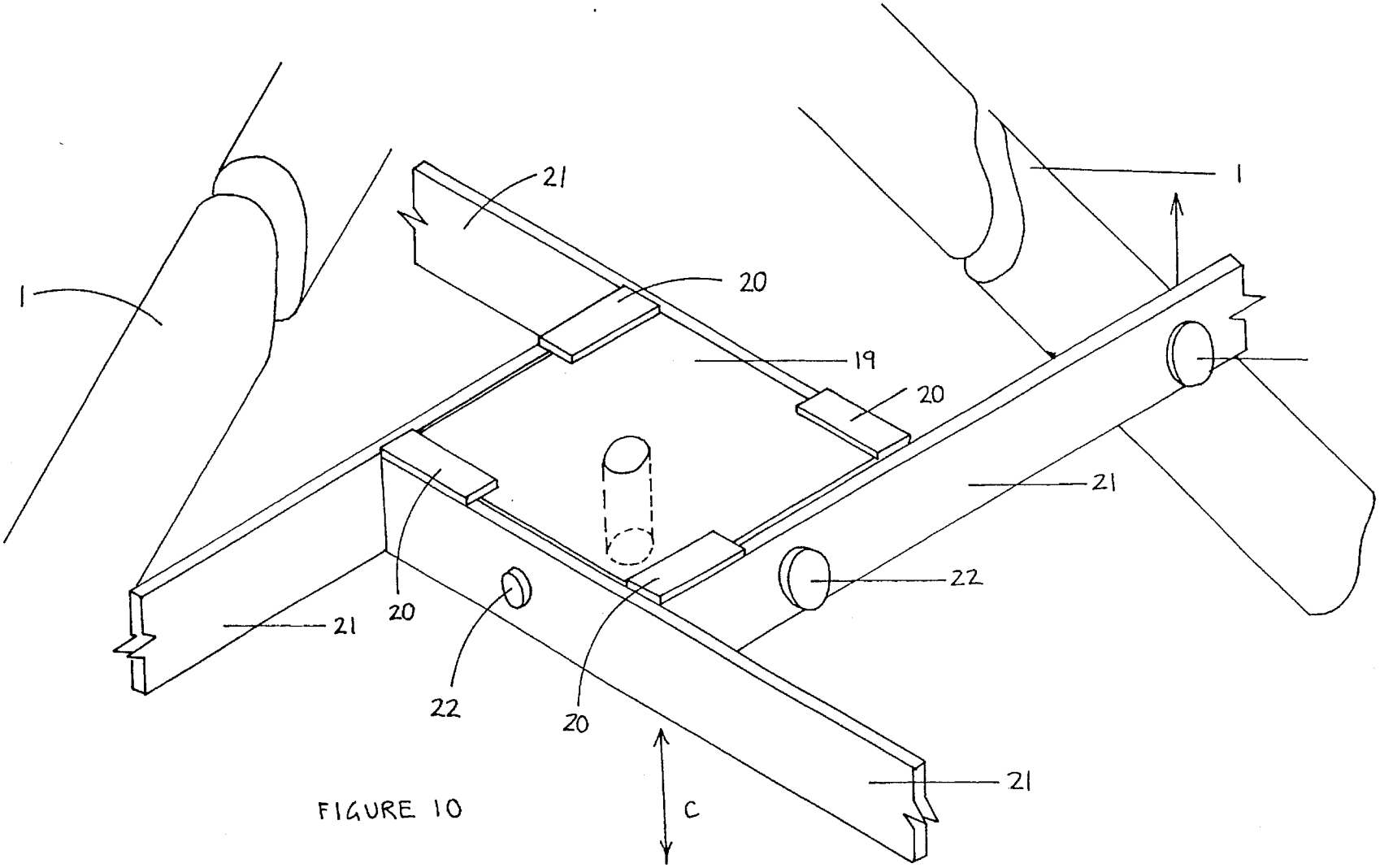
FIG. 10 shows one form of bracket for extending the apex poles out to their raised configuration.

By virtue of these novel hinged joints between the apex and perimeter poles the structure in use may be transported to the desired location in the collapsed configuration shown in FIG. 9 where the major structural components such as the apex and perimeter poles, while remaining connected, are conveniently bundled together in a compact substantially parallel configuration with the attached cover sheet 8 folded between them. On site the structure is opened from this collapsed configuration by manipulating a centre bracket assembly which links the apex poles intermediate their ends. One possible form of such bracket is shown in FIG. 10. It may comprise a block member 19 to which lugs 20 are attached at each corner. Braces 21 are pivotally attached between each of the apex poles 1 and the sides of the block by means of bolts or rivets 22. During opening of the structure the bracket is pushed upward to stop at the position shown in FIG. 10 so that the braces 21 spread the respective apex poles 1 apart to take the form of the central pyramid structure shown in FIG. 1. The perimeter poles are also simultaneously spread with the ends of the apex poles to form an inverted V before being rotated outwardly (see FIG. 1 arrow B) and secured in place using the joint arrangments of FIGS. 6, or 7 and 8. The cover 8 which is attached to the apex and perimeter poles is thereby spread taut into a neat and attractive geometrical shape. Preferably the lugs 20 which are located at each corner of the block 19 stop the braces pivoting past the position shown in FIG. 10 and thus limit any further upward movement of the bracket. The support legs 18A are then inserted into the sleeves 18 to elevate the structure.

After use the structure is easily collapsed again by partially pulling the bracket assembly 19 in the downward direction (arrow C) to unlock it, removing the support legs 18A, folding the perimeter poles inwardly towards the apex pole and then pushing any two apex poles towards the centre of the structure whereupon all remaining apex and perimeter poles will be drawn inward to close to a substantially parallel position with the cover folding between them.

Figure 11A:
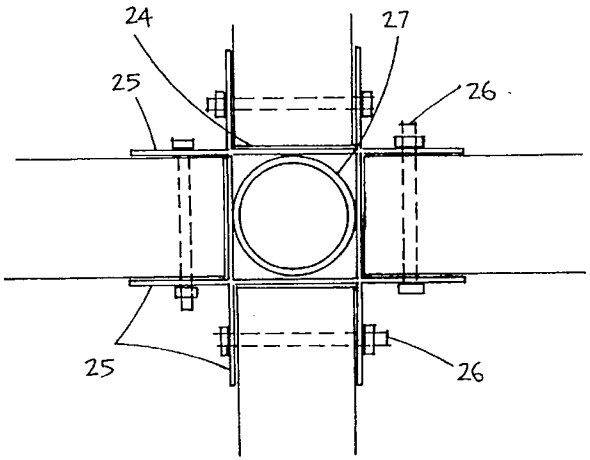
FIGS. 11 and 11A shows a second form of bracket for connecting the ends of the apex poles.
Figure 11:
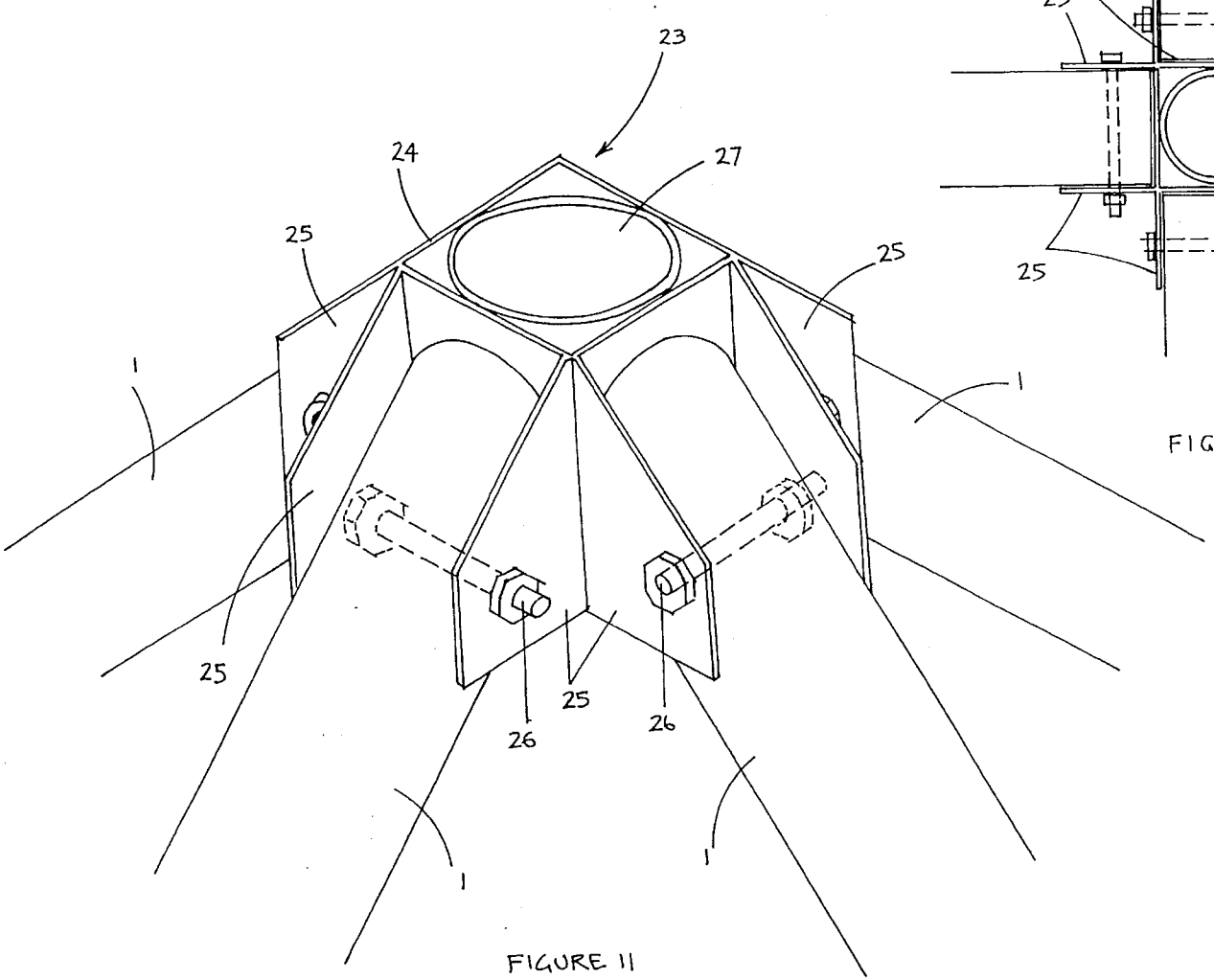
Figure 12:
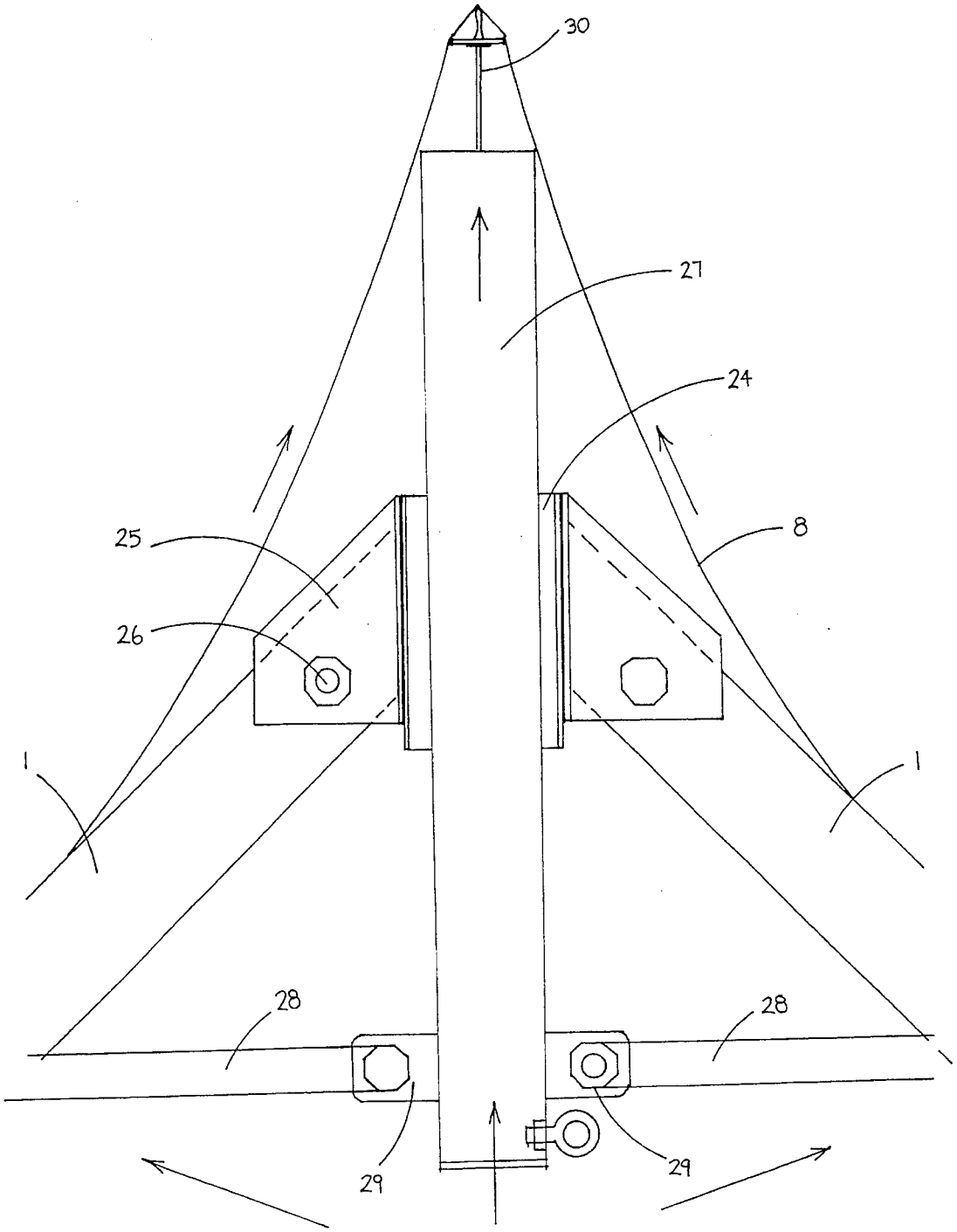
FIGS. 12 and 13 show a second form of mechanism for extending the apex poles out to their raised configuration using the connecting bracket of FIGS. 11 and 11A, and FIGS. 14 to 16 show a second means of connecting the ends of the perimeter poles and apex poles.
Figure 13:
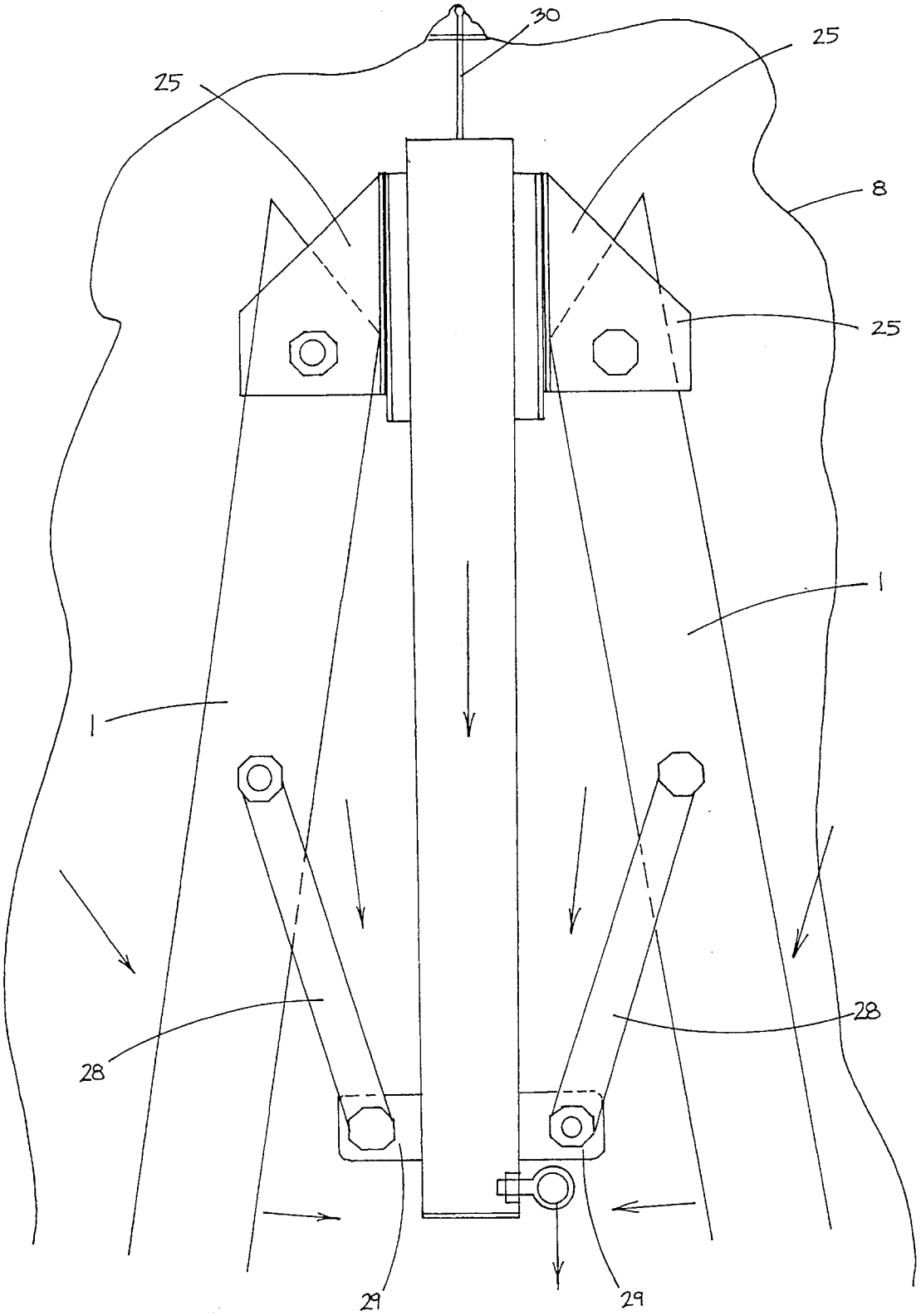
Figure 14:
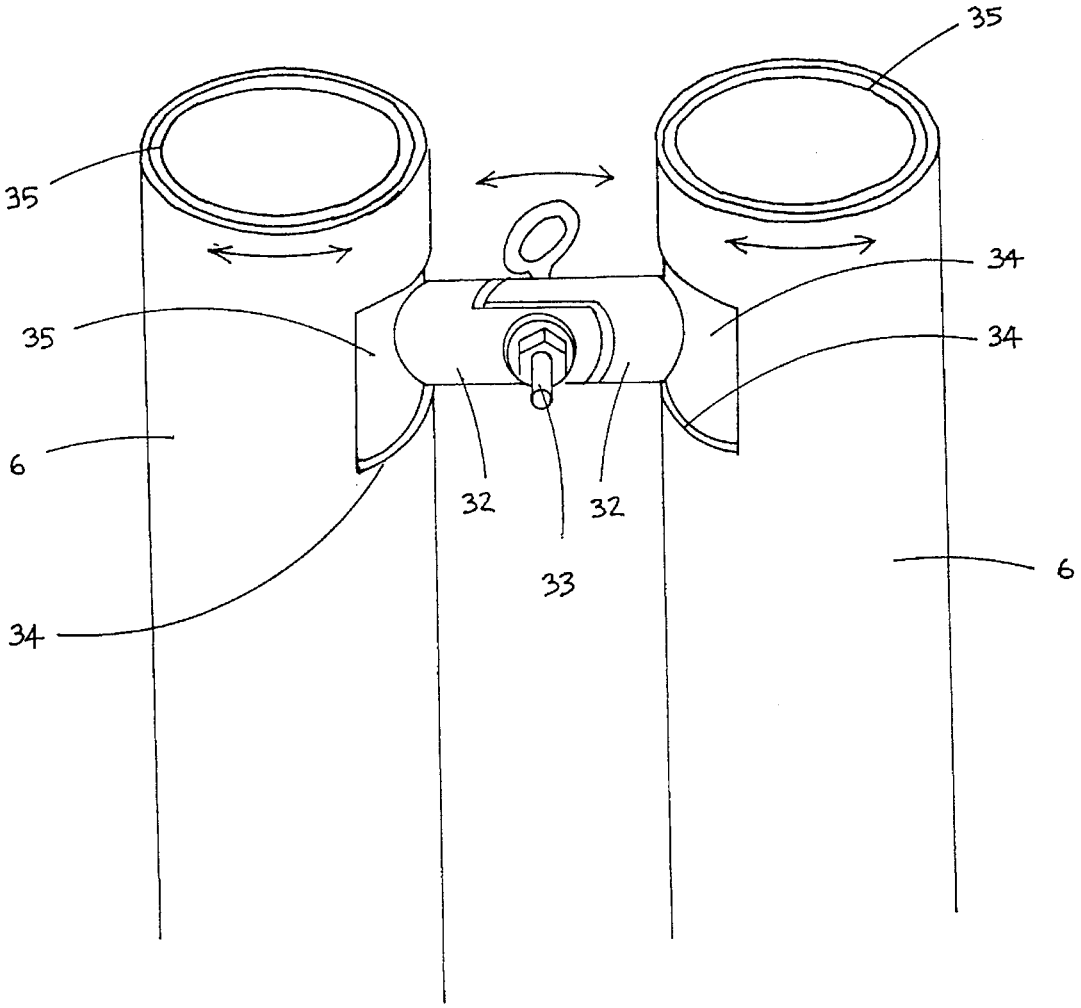
Figure 15:
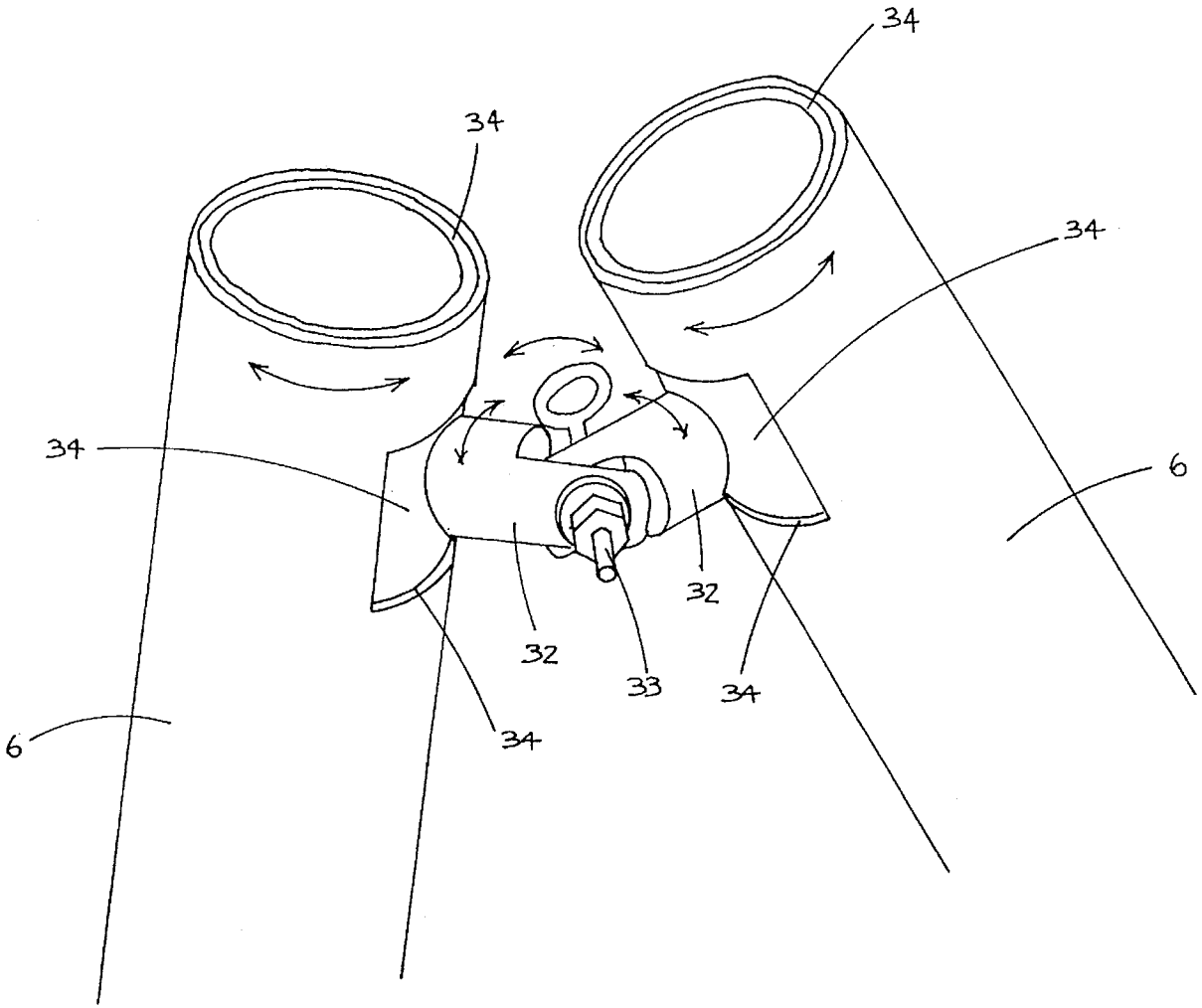
Figure 16:
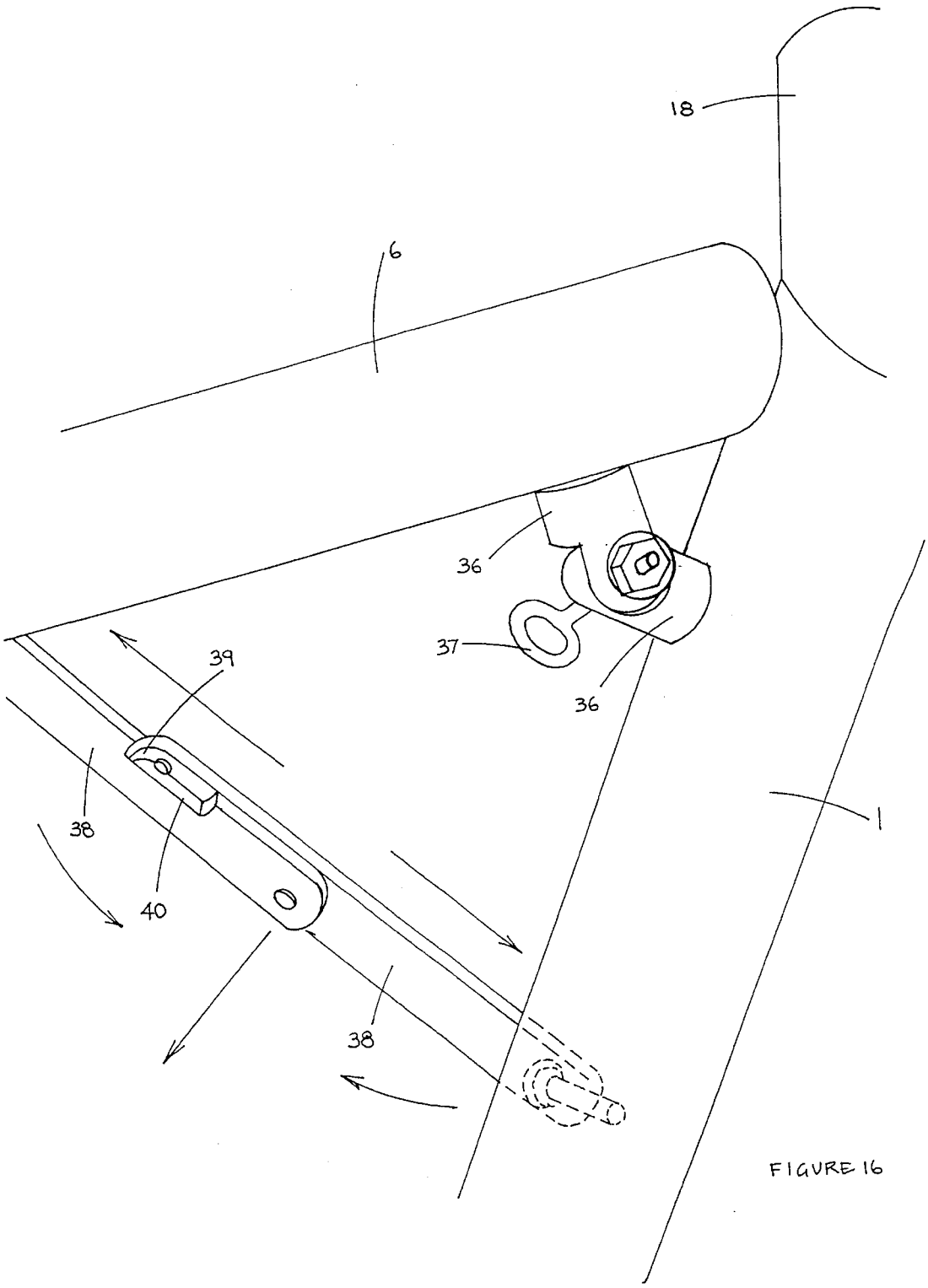

A second embodiment of the invention is shown in FIGS. 11 to 16. In this case (see in particular FIGS. 11 and 11A) the connector piece 23 for the uppermost ends of the apex poles 1 comprises a central square shaped slide member 24 having pairs of laterally extending wings 25 between which the ends of the apex poles are hinged by transverse bolts 26. The ends of the apex poles are preferably cut at an angle of 45 so as to engage the sides of the slide member and limit the opening angle of the apex poles. As also shown in FIGS. 12 and 13 the slide member 24 encloses a centre pole 27 which is slidable in the vertical direction as indicated by the arrows. Struts 28 link fixed flanges 29 on the centre pole to respective apex poles 1 intermediate the ends thereof. The mechanism is therefore arranged such that the centre pole may be moved relative to the connector piece 23 between the lower position shown in FIG. 12 where the apex poles extend out and support the canopy 8 and the upper position shown in FIG. 13 where the apex poles are folded inwardly toward the centre pole and the canopy is collapsed. A spigot 30 may be fitted to the top of the centre pole to form a neat and taut centre point for the raised canopy. Preferably an eye bolt 31 is also fitted adjacent the lower end of the centre pole to facilitate its vertical displacement using a hooked bar or the like.

With this embodiment the joints between each pair of perimeter poles 6 (shown in the collapsed and open configurations by FIGS. 14 and 15) may take the form of lugs 32 which are fitted to these poles adjacent their ends.

The outer ends of the lugs intermesh and are pivotally connected by an eye bolt 33. These lugs preferably also pivot axially as shown by arrows and in addition may have a limited amount of movement within the enlarged aperture 34 through the walls of the perimeter poles by virture of their attachment to sections of internal sleeve 35. It is envisaged that this arrangement would provide a strong and durable mechanical joint between the poles while still allowing relative movement with up to several degrees of freedom.

A similar type of mechanical connection may be used to link the other ends of the perimeter poles to respective apex poles using pairs of interconnecting lugs 36 and an eye bolt 37. In this case however the two poles are secured in the open position shown by a set of hinged stays 38. These open straight so that a prong 39 on one engages in a recess 40 in the other to form a stable crosspiece which may nevertheless be easily folded again by displacing the centre toward the joining ends of the poles.

It will thus be appreciated that this invention at least in the form of the embodiments described provides a novel and useful improvement in the structure of temporary shelters. Clearly however the examples described are only the currently preferred forms of this invention and a wide variety of modifications may be made which would be apparent to a person skilled in the art. For example, the shape and configuration of the shelter when erected, the number of apex and perimeter poles used, the type of and method of fixing the cover material to the frame, the type of connectors for said poles and the method of connecting adjacent units may all be varied according to design preference. Also while it is preferred to use hollow aluminium poles the invention extends to any other suitable material.

I claim:

1. A collapsible support structure for a cover means, said structure comprising at least three apex poles with first ends pivotally connected together so that in use said poles are movable between a raised configuration in which the second opposite ends extend outwardly in different directions to create a pyramid shaped frame and a collapsed configuration, and pairs of perimeter poles with each pair forming an inverted V between said opposite ends of adjacent apex poles when in said raised configuration and bracket means comprising struts which extend between and are pivotally attached to respective apex poles intermediate their ends and a central flange means whereby the first connected ends of said apex poles and said central flange means may be pushed toward each other to obtain said raised configuration or pushed apart to obtain said collapsed configuration and said apex poles and perimeter poles being pivotally connected so as to fold together into close substantially parallel positions when in said collapsed configuration.

2. The support structure as claimed in claim 1 wherein the first ends of said apex poles pivotally connect to a slide member which is slidable along a centre pole and said cental flange means comprises a set of flanges fixed to said centre pole.

3. The support structure as claimed in claim 2 wherein said slide member has pairs of laterally extending wings between which the first ends of said apex poles are pivotally connected by transverse bolts or pins.

4. The support structure as claimed in claim 3 wherein the connections between the perimeter and apex poles comprise pairs of laterally extending lugs which are fitted to the poles adjacent their ends, the outer ends of the lugs intermeshing and being pivotally connected by a bolt or pin.

5. The support structure as claimed in claim 4 wherein the connections between the pairs of perimeter poles also comprise pairs of said laterally extending lugs, said lugs having a limited amount of movement within enlarged apertures in the walls of the perimeter poles by virtue of their attachment to internal sleeves.

6. The support structure as claimed in claim 4 wherein the connected apex and perimeter poles are secured in an open position by sets of hinged stays.

7. The support structure as claimed in claim 6 wherein a spigot is fitted to the top of the centre pole to form a neat and taut centre point for the cover means.

8. The support structure as claimed in claim 7 wherein the second opposite ends of the apex poles are adapted to removably connect with support legs by angled sleeves.

9. The support structure as claimed in claim 8 wherein the slide member is square in cross-section.

* * * * *